United States Patent [19]

Marshall

[11] Patent Number: 4,554,189

[45] Date of Patent: Nov. 19, 1985

[54] ARTICLES FOR COOLING BEVERAGES

[76] Inventor: Randall S. Marshall, 8149 E. Branch Dr., Washington, D.C. 20012

[21] Appl. No.: 563,598

[22] Filed: Dec. 20, 1983

[51] Int. Cl.[4] ..... A63H 3/00; F25D 3/08

[52] U.S. Cl. ..... 428/11; D7/42; 62/293; 62/530; 428/16; 428/913; 446/267

[58] Field of Search ..... D7/42; 62/293, 529, 62/530; 428/11, 16, 913; 446/267, 268

[56] References Cited

U.S. PATENT DOCUMENTS

| | | | |
|---|---|---|---|
| 490,902 | 1/1893 | Galbreath | 62/529 |
| 1,641,139 | 8/1927 | Glennan | 62/530 X |
| 1,758,008 | 5/1930 | Mock | 62/530 X |
| 1,923,522 | 8/1933 | Whitehouse | 62/530 |
| 1,944,726 | 1/1934 | Aiken | 62/293 |
| 2,016,514 | 10/1935 | Putnam | 62/293 |
| 2,036,706 | 4/1936 | Law | 426/85 |
| 2,181,697 | 11/1939 | Kavalir | 428/35 X |
| 2,264,971 | 12/1941 | Glennan | 62/530 |
| 2,688,467 | 9/1954 | Leatzow | 62/293 X |
| 4,091,632 | 5/1978 | Marchewka et al. | 62/530 X |
| 4,134,494 | 1/1979 | Wong | 426/85 X |
| 4,325,230 | 4/1982 | Driscoll et al. | 62/293 |

OTHER PUBLICATIONS

House Beautiful Magazine, p. 115, Sep. 1965.

*Primary Examiner*—Henry F. Epstein
*Attorney, Agent, or Firm*—Millen & White

[57] ABSTRACT

An article for cooling a beverage includes a container of plastic material for containing a phase-change medium such as water. The cooling article is used by freezing the phase-change medium and immersing the article in the beverage. The article is preferably weighted to compensate for its positive buoyancy so that it is either generally suspended within the beverage or at the bottom of the beverage. Preferably, the article has projections thereon which increase its surface area, and the article may include internal metallic fins to increase the rate at which heat is transferred from the surface of the article to the interior thereof. If desired, the article may be configured to provide a secondary meaning, and it may include a phosphorescent medium so as to glow in areas of little or no light.

4 Claims, 9 Drawing Figures

ARTICLES FOR COOLING BEVERAGES

BACKGROUND OF THE INVENTION

1. Field of the Invention

The instant invention relates to articles for cooling beverages. More particularly, the instant invention relates to an article for cooling beverages wherein the article is configured as a container of plastic or similar material which has a phase-change medium, such as water, therein. The phase-change medium is frozen in the container prior to placing the container in a beverage. As it consumes heat from the beverage, the phase-change medium liquifies but is confined to the container.

2. Prior Art and Technical Considerations

Many beverages are preferably consumed when cold and in order to keep beverages cold people generally freeze water into ice and deposit the ice in their beverages. In order to cool a beverage, the ice consumes heat from the beverage, changing phase and becoming water which dilutes the beverage and frequently spoils its taste. Moreover, ice floats on the surface of the beverage. Consequently, if one is drinking a beverage from a glass or cup the beverage is continually consumed from the surface adjacent the ice cubes and, therefore, is continually diluted. In addition, the ice cubes tend to come into contact with the drinker's lips which is not necessarily a pleasant sensation. Moreover, the flavor of many drinks sinks to the bottom while the drink is being consumed or cooled. If a straw is used, then the concentrated flavoring is drawn off first without necessarily being cooled by the ice. Accordingly, conventional ice cubes are a rather unsatisfactory proposition all the way around.

The problem of cooling drinks with ice cubes has been with us for a considerable period of time and until the instant invention has not had a satisfactory solution. For example, U.S. Pat. No. 490,902 issued in 1893 to Galbreath discloses a metal container which floats on the surface of a beverage and is removed after the beverage is cooled. U.S. Pat. No. 1,944,726 discloses a cooling device with a handle that is inserted into a beverage and is used to stir the beverage as it is cooled by the device. U.S. Pat. No. 4,325,230, which issued Apr. 20, 1982, discloses cubes which float on the surface on a beverage and include indicators which show when the ice is melted. There are numerous other patents directed to this concept, but none cover devices which are widely used or have achieved any degree of commercial success. The aforementioned problems with conventional ice cubes continue.

SUMMARY OF THE INVENTION

In view of the aforementioned difficulties with ice cubes and proposed solutions to those difficulties, it is an object of the instant invention to provide new and improved articles for cooling beverages.

In order to achieve this object, the instant invention contemplates an article for cooling drinks wherein the article comprises a container having a wall of plastic material completely inclosing a space. A phase-change medium is confined within the space by the wall and changes phase from a solid state to a liquid state at approximately the melting point of water ice. Weight means are attached to the container to compensate for any positive buoyancy thereof, whereby the container does not float at the top of the liquid being cooled thereby.

The instant invention further contemplates providing the container with a main body portion and projecting portions which increase the surface area of the container to promote rapid cooling of the beverage in which the container is submerged. It is further within the principals of this invention to configure the containers in a recognizable form having a secondary meaning and to include phosphorescent material in the container so that the cooling article glows in areas having little or no light. The instant invention further contemplates including a plurality of metallic fins or stems within the container which extend from the wall of the container into the main body portion so as to promote rapid cooling of the beverage in contact with the container.

DESCRIPTION OF THE PREFERRED EMBODIMENT

Figure 1:
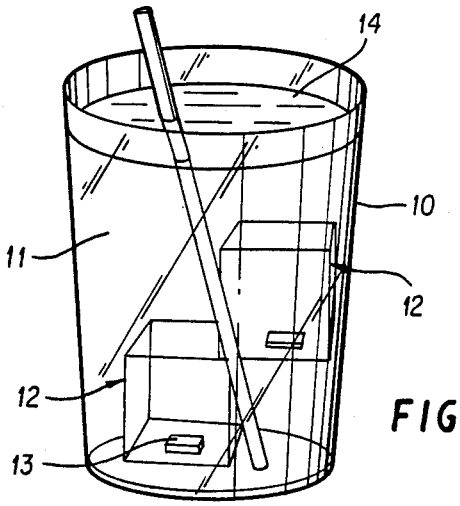
FIG. 1 is a perspective view showing a glass with a beverage therein being cooled by articles configured in accordance with the teachings of the instant invention.

Referring now to FIG. 1, there is shown a glass 10 which includes a beverage 11 and articles, generally designated by the numerals 12, for cooling the beverage 11, the articles 12 being configured in accordance with the principals of the instant invention.

The articles 12 are enclosed plastic containers containing a phase-change medium, such as water, which changes phase from its solid form (ice) to a liquid. In order to accomplish this change in phase, the phase-change medium absorbs heat from the beverage in which it is situated, thereby cooling the beverage. Since the phase-change medium is contained with a container, it does not flow out into the beverage and dilute the beverage has it melts. In order to cool the lower portion of the beverage where most of the flavor of many drinks tends to accumulate, the cooling articles 12 include weights 13 which compensate for the positive buoyancy of ice. The weights 13 may be just heavy enough so that the articles 12 tend to be suspended in the beverage 11 or the weights may be sufficiently heavy to completely sink the articles to the bottom of the glass 10. The basic concept is to keep the cooling articles 12 away from the top surface 14 of the beverage so that in addition to cooling the lower portion of the beverage, the cubes tend not to float into contact with ones lids.

Figure 2:
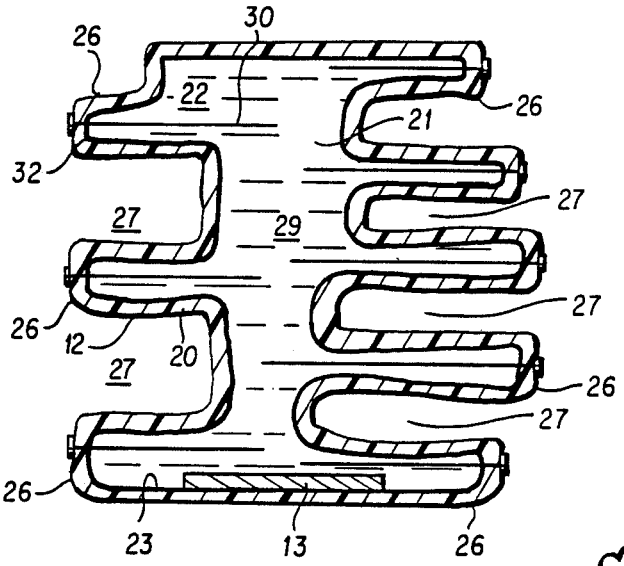
FIG. 2 is an enlarged cross-section of embodiment that an article configured in accordance with the principals of the instant invention might assume.
Figure 3:
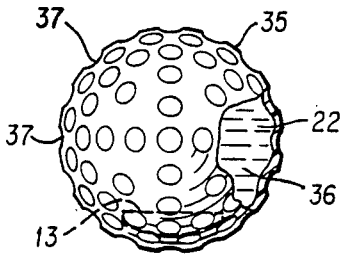
FIG. 3 discloses another embodiment of the instant invention wherein the cooling article is configured as a golf ball.

Referring now to FIG. 2, wherein one enbodiment of the instant invention is shown in a somewhat schematic configuration. The container 12 includes a wall 20 which completes encloses a space 21. The space 21 is filled with a phasechange medium 22 which may be for example, water, salt-water or a water admixture. The wall 20 is made of plastic which is somewhat elastic so that when the phase change material 22 expands upon freezing, the wall 20 will not crack. In addition, the wall 20 should be made of a plastic which is resistant to high temperatures, so that the cooling article 12 can be washed in a dishwasher, if necessary or desired. In the embodiment of FIG. 2, a weight 13 is secured to a bottom surface 23 of the wall 20 so as to sink the cooling article 12 in the beverage with which it is used or at least to compensate for the positive buoyancy of the cooling article.

As is further seen in FIG. 2, the cooling article 12 includes a plurality of projections 26 which served to increase the cooling area of the article. The projections 26 necessarily increase the surface area of the cooling article 12, thereby promoting rapid cooling of the beverage in which the article is immersed. It is to be kept in mind that the projections 26 also form indentations 27 and that all projections form indentations depending upon how one views the article. In essence, the projections 26 function somewhat in the manner as fins in that portions of the beverage in contact with the projections are cooled by conduction. Moreover, movement of the cooled beverage in proximity with the projections 26 further cools adjacent liquid by convection.

Further considering FIG. 2, the projections 26 extend from a main body portion 29 which includes the bulk of the phase change medium 22. In order to increase the rate of heat transfer from the projections 26 to the main body 29 so as to increase the rate at which heat flows from the beverage into the cooling article 12, a plurality of metal plates or in the alternative rods, 30 extend inwardly from the wall 20 into the main body portion 29.

In accordance with one embodiment of the invention, the wall 20 may be either transparent or translucent so as to transmit light or the wall may be opaque. A layer of phosphorescent material 32 may line the inner surface of the wall 20 so that the cooling article 12 will glow in areas of little or no light. Alternatively, the walls of the container itself may include phosphorescent material or a phosphorescent stick-on. In the alternative, phosphorescent material may be mixed with the phase-change medium 22 so as to illuminate the article.

As is seen in FIGS. 3, 4, 7 and 8, the article may assume various configurations. In FIG. 2, the article 12 is configured as a golf ball 35 having a hollow interior 36 which is filled with the phase change material 22. Indentations 37 in the surface of the "golf ball" 35 increase the surface area and promote rapid cooling. As with the embodiment shown in FIG. 2, plates or rods such as the elements 30 of FIG. 2 may be included with the golf ball so as to increase the rate of heat transfer. In addition, a weight 13 (shown on dotted lines) may be utilized to compensate for positive buoyancy of the golf ball.

Figure 4:
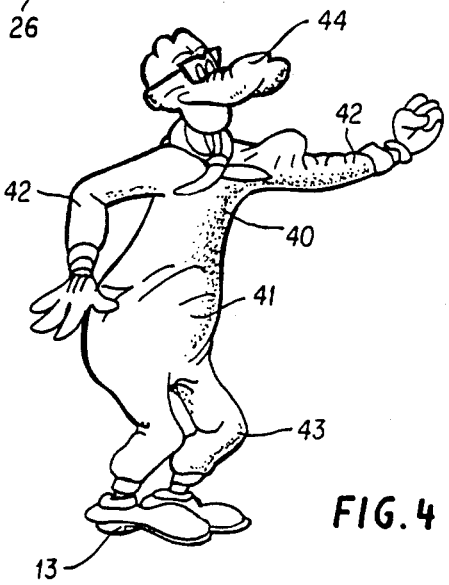
FIG. 4 discloses still another embodiment of the invention wherein the article is configured as a three-dimensional cartoon character.

In FIG. 4, the article 12 is configured as a three-dimensional cartoon character 40 having a body portion 41 and various appendages 42, 43, and 44 which serve as projections to increase the surface area of the article. Again, the embodiment of FIG. 4 may include all of the features shown in FIG. 2. In order to correctly orient the FIG. 40, the weight 13 may be attached to the figure's feet.

Figure 7:
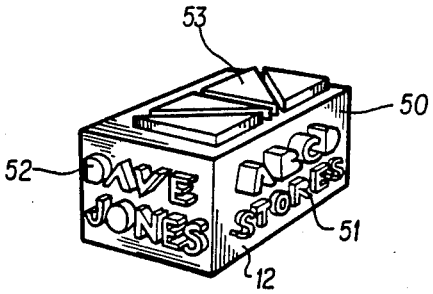
FIG. 7 is an article in accordance with the instant invention including letters and logos to convay a message.
Figure 8:
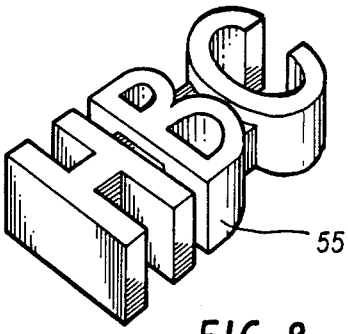
FIG. 8 is an article in accordance with the instant invention wherein the entire article is configured as a written message.

As is shown in FIG. 7, the article 12 may be configured as a block 50 which has raised letters 51 or 52 thereon spelling a business name, a trademark or perhaps a personal name. Any sort of message or commercial language may be included with the article, such as a logo 53, for example. In an alternative embodiment shown in FIG. 8, the entire article forms a message which may be, for example, an array of letters 55. Cooling articles 12 configured such as the block 50 or letter aray 55 can be used by commercial establishments to advertise their businesses. When the patrons leave, they may have a tendancy to take the articles 12 with them which is, of course, a method of distributing advertising material.

Figure 5:
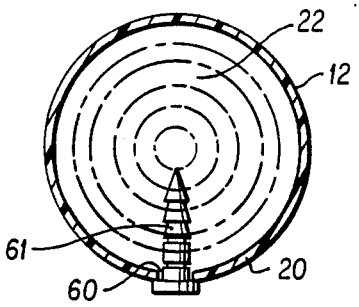
FIG. 5 discloses still another embodiment of the invention, in cross-section, wherein the article is provided with an opening and a plug.
Figure 6:
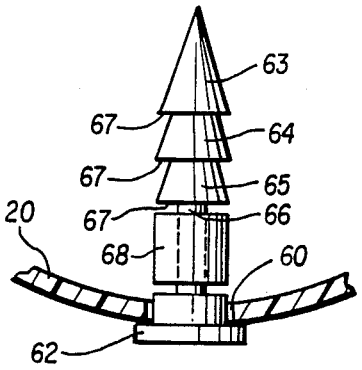
FIG. 6 is an enlarged view of the plug utilized with the embodiment of FIG. 5, showing a weight included with the plug.

Referring to FIGS. 5 and 6, the article 12 is provided with an opening 60 through the wall 20 so that the user may fill the article himself with phase-change medium 22. In this case, the phase-change medium 22 is preferably water. A plug, designated generally by the numeral 61, is inserted through the opening 60 to close the opening 60. The plug has an enlarged head 62 which has a diameter greater than the opening 60 so as to seal the opening 60. The plug 61 includes a plurality of conical projections 63, 64 and 65 around a shank 66. The conical projections taper in a direction away from the head 62. As the water in the article 12 freezes, it freezes from the outside in and expands against the lands 67 on the conical projections 63, 64 and 65 so as to hold the plug 61 in place. The plug 61 may be made of any convenient material such as metal or plastic and if necessary can include a weight 68 around the shank 66 so as to compensate for positive buoyancy of the cooling article 12.

Figure 9:
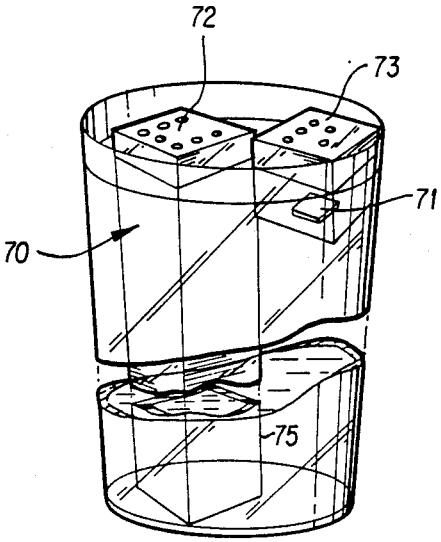
FIG. 9 is a perspective view wherein the cooling article has a braille message on the surface thereof.

Referring now to FIG. 9, cooling articles, designated generally by the numerals 70 and 71, are provided with braille messages 72 and 73, respectively thereon. The cooling article 70 has an elongated shank portion 75 which rests on the bottom 77 of the glass 78 in order to insure that the braille message 72 is above the surface of the beverage. In an alternative embodiment, the cooling article 71 floats in the beverage with the message 73 above the surface of the liquid. A weight 80 may be used to keep the cooling article properly oriented. The cooling articles 70 and 71 each contain a phase-change medium, such as medium 22 of FIG. 2, and are completely enclosed to prevent the phase-change medium from diluting the beverage as the medium melts.

While several specific embodiments of the invention have been described, it is to be kept in mind that the cooling articles may assume any number of configurations and still remain within the scope of this invention. For example, the cooling articles may be configured as: tennis balls, baseballs, basketballs, footballs, buildings, people, animals, books, bottles, containers, automobiles, airplanes, industrial devices and parts, computers, telephones, equipment, shoes, foods, appliances, beer containers, futuristic machines, precious stones, three-dimensional comic and cartoon-stip characters, electronic and conventional game characters, etc. In addition, various alphabets may be used, and the container walls may be translucent or opaque as well as transparent, or the walls may be of various colors.

The foregoing illustrations and examples are merely exemplary of the invention which is to be limited only by the following claims.

What is claimed is:

1. An article for cooling beverages and the like, the article comprising:

a container having a wall of plastic material completely enclosing a space, the wall defining a hollow main body portion and a plurality of hollow projecting portions communicating with the main body portions which hollow projecting portions increase the surface area of the container;

a phase-change medium confined within the hollow main body portion and plurality of hollow projecting portions, the phase-change material changing phase from a solid state to a liquid state at approximately the point at which ice melts to water and the presence of the phase-change material in the hollow pojecting portions promoting rapid cooling of the beverage;

a plurality of metallic elements projecting inwardly from those portions of the wall defining the hollow projecting portions of the container to further increase the heat transfer rate from the wall and projections to the bulk of the phase-change medium, and weight means within the container to compensate for positive buoyancy thereof, whereby the container does not float at the top of the beverage being cooled thereby.

2. The article of claim 1 further including a phosphorescent material contained by the article wherein the article glows in the dark.

3. The article of claim 1 wherein the phase change material is water.

4. The article of claim 1 wherein the article is configured as a cartoon character with the main body portion being the body of the character and the limbs being the hollow projecting portions.

* * * * *